United States Patent [19]

Zarotti

[11] Patent Number: 4,969,684

[45] Date of Patent: Nov. 13, 1990

[54] STRUCTURE FOR AN EASY CHAIR, SOFA AND THE LIKE

[76] Inventor: Claudio Zarotti, Via Marco Polo 7, 20124 Milano, Italy

[21] Appl. No.: 395,301

[22] Filed: Aug. 18, 1989

Related U.S. Application Data

[63] Continuation of Ser. No. 180,243, Apr. 11, 1988, abandoned.

[30] Foreign Application Priority Data

Apr. 3, 1987 [IT] Italy ..... 19975 A/87

[51] Int. Cl.[5] ..... A47C 7/72

[52] U.S. Cl. ..... 297/180; 297/284; 297/DIG. 3; 5/455; 428/69; 128/33

[58] Field of Search ..... 297/180, 284, 452, 458, 297/459, 460, DIG. 3, DIG. 8; 5/453, 455, 456, 449, 450; 128/33; 62/3, 261; 428/69, 305.5

[56] References Cited

U.S. PATENT DOCUMENTS

| | | | |
|---|---|---|---|
| 3,549,201 | 12/1970 | Wolfe | 297/284 |
| 3,648,469 | 3/1972 | Chapman | 297/180 X |
| 3,850,714 | 11/1974 | Adorjan | 428/69 X |
| 3,857,753 | 12/1974 | Hansen | 428/69 X |
| 3,915,421 | 10/1975 | Le Forestier | 297/DIG. 3 X |
| 3,982,786 | 9/1976 | Burgin et al. | 297/284 |
| 4,059,909 | 11/1977 | Kron | 297/180 X |
| 4,258,706 | 3/1981 | Shank | 297/180 X |
| 4,542,547 | 9/1985 | Sato | 5/453 |
| 4,619,481 | 10/1986 | Grundzinskas . | |
| 4,634,179 | 1/1987 | Hashimoto et al. | 297/DIG. 3 X |
| 4,686,722 | 8/1987 | Swart | 5/453 |
| 4,694,520 | 9/1987 | Paul et al. | 5/455 X |

FOREIGN PATENT DOCUMENTS

| | | |
|---|---|---|
| 0232228 | 8/1987 | European Pat. Off. . |
| 2168893 | 7/1986 | United Kingdom . |

OTHER PUBLICATIONS

European Search Report, 6/27/1988.

*Primary Examiner*—Laurie K. Cranmer
*Attorney, Agent, or Firm*—Sughrue, Mion, Zinn, Macpeak & Seas

[57] ABSTRACT

A structure for an easy chair, sofa, or the like, which affords improved comfort and a simple construction, comprises a plurality of deformable sealed blisters containing a fluid having a set boiling temperature, such as a Freon, and electric resistance heaters associated with said blisters to vary the fluid temperature and, hence, the blister volumes and pressures.

16 Claims, 2 Drawing Sheets

STRUCTURE FOR AN EASY CHAIR, SOFA AND THE LIKE

This is a continuation of application Ser. No. 07/180,243 filed Apr. 11, 1988, now abandoned.

DESCRIPTION

This invention relates to a structure for an easy chair, sofa or the like.

A basic requirements of sofas, easy chairs, and the like is that their users should be afforded comfort to the highest degree, by meeting their demands both as regards sitting posture and the peculiarly soft and yielding character of seat, backrest, and armrests, where provided, in relation to the user's build and individual contingent preferences.

Known are easy chairs having a bearing frame made up of a number of parts which interfit either for mutual articulation or a sliding movement, being provided with respective intermeshing gears or screws driven by some motive means for changing their relative angles and positions.

Such easy chairs are quite complicated and heavy constructions, being more like some piece of machinery.

The use, which has been suggested, of oil-operated cylinders or hydraulic jacks, while making for simpler mechanical linkages, is bound to aggravate costs.

Easy chairs have been proposed which have special cushions stuffed with a loose inert filler material capable of taking a set conformant to the impression left in it by the sitting user, the impression being retained by virtue of a vacuum being formed inside the cushions. This approach is effective to provide for a desired sitting position but leaves much to be desired under the aspect of its soft and yielding features. In fact, easy chairs fitted with such cushions rather give the the impression of sitting on a fairly rigid cast. Further, the easy chair must be equipped with a vacuum pump, which increases its cost.

It has also been suggested of providing easy chairs with small inflatable mattresses laid over the seat and/or the backrest. This approach involves, however, the availability of an air compressor, a piece of equipment that is conducive to well-recognized problems connected with its being unsuited for use in a dwelling environment.

Known are, moreover, easy chairs and sofas wherein a desired degree of comfort has been achieved through the use of paddings of different consistency, e.g. to be formed from foam and latex materials having different densities. Such an approach, while being in many ways advantageous, for example, on account of its making for a simplified construction, cannot fulfil all the expectations of a wide panel of users: by providing soft features which are in essence the outcome of a compromise, it may at most appeal to users of average build and common taste.

The problem that underlies this invention is to provide a structure for an easy chair, sofa, and the like, which can meet the above-outlined requirements and at the same time overcome the drawbacks noted in connection with the background art.

This problem is solved by a structure as indicated for an easy chair, sofa, and the like being characterized in that it comprises, located in the area of the seat and/or backrest, a plurality of deformable sealed blisters containing a fluid having a set boiling temperature, and heater means associated with said blisters for changing the temperature of said fluid.

Further features and the advantages of the structure for an easy chair, sofa, and the like, according to this invention, will be more clearly apparent from the following detailed description of a preferred embodiment thereof, to be taken by way of illustration and not of limitation in conjunction with the accompanying drawings, where:

Figure 1:
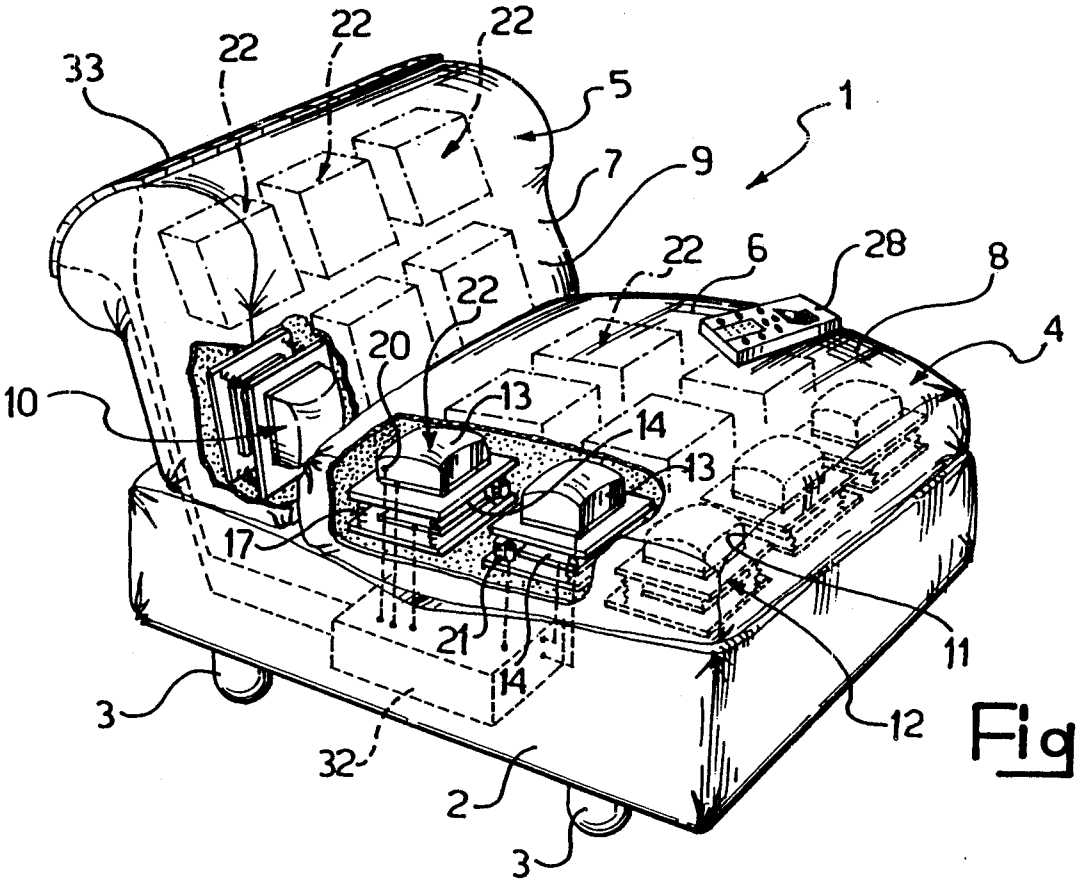
FIG. 1 is a part-sectional perspective view, showing schematically an easy chair structure according to the invention.
Figure 2:
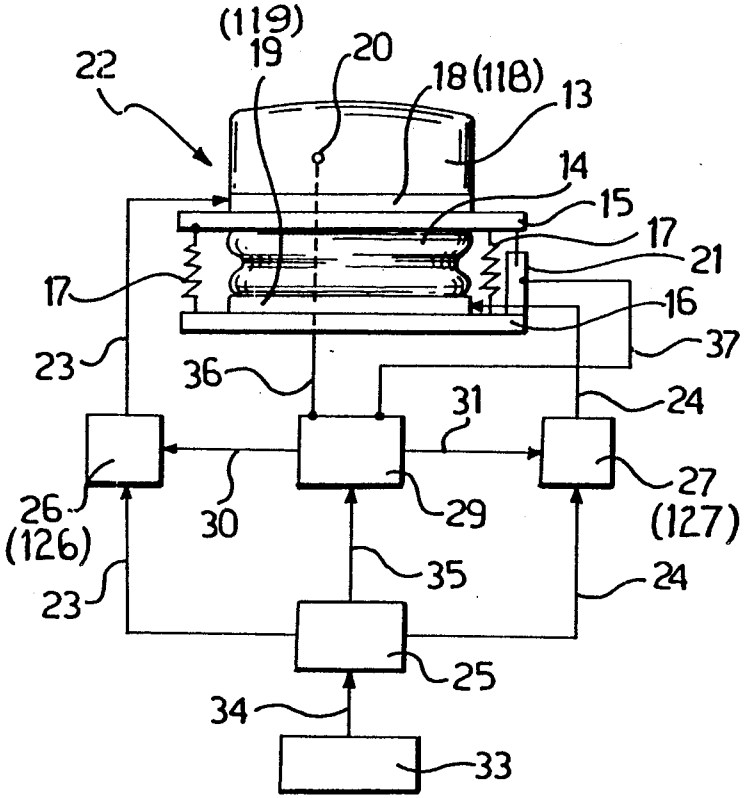
FIG. 2 is a schematical detail view of the easy chair shown in FIG. 1.
Figure 3:
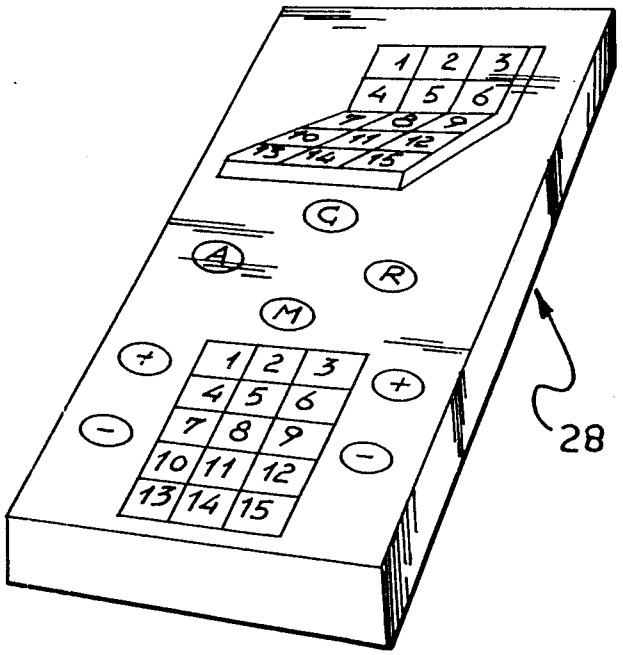
FIG. 3 is a perspective view of another detail of the easy chair structure of FIG. 1.

With reference to the drawing views, the numeral 1 therein comprehensively designates an easy chair embodying a structure in accordance with this invention.

The easy chair 1 comprises a frame 2 intended to rest on the floor with the intermediary of feet 3 and defining a seat 4 and backrest 5.

The easy chair 1 includes two cushions 6 and 7 associated with the seat 4 and the backrest 5, respectively. These cushions consist of polyurethane foam covered with a liner and have respective exposed rest surfaces 8 and 9 for the user.

The easy chair 1 according to the invention further comprises a plurality of blisters 10 distributed across the seat 4 and the backrest 5 and embedded in the polyurethane foam of the cushions 6 and 7.

More specifically, the blisters are distributed in two sets, 11 and 12. Advantageously, the sets 11 and 12 are composed of respective superimposed blister layers. The first layer of blisters, 11, is the upper one, that is, locates next to the exposed surfaces 8 and 9 of the cushions, whereas the second layer 12 is the lower one and adjacent the first layer 11, on the remote side of the latter from the exposed surfaces 8 and 9.

The blisters in the first layer 11, collectively designated 13, and the blisters in the second layer, collectively designated 14, are in juxtaposed pairs and distributed regularly across the seat 4 and the backrest 5. In the example shown, there are provided fifteen such blisters 13 and fifteen blisters 14, namely, six located in the backrest and nine located in the seat. Thus, there are defined fifteen corresponding areas which are identified with respective numerals "1" to "15".

The blisters 13 and 14 are formed of a sealed impervious deformable film and contain a fluid having a set boiling temperature close to room temperature.

In particular, the film forming the blisters 13 and 14 is made of a laminate material comprising layers of a plastics material and layers of a metal material permanently cemented together. As an example, that material may comprise, proceeding from a blister inside out, a polyester layer, nylon layer, aluminum layer, and polythene layer.

As for the fluid, this is advantageously a mixture of several Freon types, Freon being the trade name used to denote a range of substances exhibiting a hydrocarbon structure with one or more hydrogen atoms substituted by halogen atoms, usually chlorine and/or fluorine but also iodine and bromine atoms. Such substances can be mixed together and have, when taken together, boiling temperatures within a very wide range which, for the most common types, extends from about minus eighty degrees (Freon 13, 23, 41, 116) up to about ninety degrees above zero (Freon 112); by mixing two or more of these substances together, fluids can be obtained which have their boiling points within that range of temperatures.

In particular, the blisters 13 in the layer 11 contain a set amount of a mixture including 70% Freon 11 (with raw formula $CCl_3F$, boiling temperature 23.7° C.) and 30% Freon 113 (with raw formula $C_2Cl_3F_3$, boiling temperature 47.7° C.), said mixture having a boiling temperature of about 30° C.

In the conditions noted above, at room temperature the blisters 13 would be normally expanded.

The blisters 14 in the layer 12 contain a set amount of a mixture comprising 20% Freon 11 and 80% Freon 113, said mixture having a boiling temperature of about 40° C.

In the conditions just noted, the blisters 14 would be normally in a collapsed state at ambient temperature.

On the boiling temperature being reached, the fluid begins to evaporate causing a blister to expand progressively. The expansion continues at a fast rate with at least some of the fluid in a vapor state, since the transition from liquid to vapor state entails a marked increase in volume. Subsequently, any further temperature increase could only result in the blister pressure increasing, since the blister cannot actually expand any further.

Each blister 14 is located between two plates 15 and 16, the plate 15 being placed on the side of the blister 13 next to the blister 14. The two plates 15 and 16 are constantly biased toward each other by springs 17 stretched therebetween.

Associated with each blister 13 is a heater means 18, in this example an electric resistance heater of the kind used, for instance, with heater blankets and quite conventional. Each resistance heater 18 is located adjacent a respective blister 13 on the side thereof facing the plate 15, for varying the temperature of the fluid within the blister.

Likewise associated with each blister 14 is an electric resistance heater 19, substantially similar to the resistance heater 18. The resistance heater 19 is located adjacent the blister 14 on the side thereof facing the plate 16, for varying the temperature of the fluid inside the blister.

With each blister 13, there is associated a pressure transducer 20 which is operative to detect the pressure level prevailing in the blister 13 and output a signal corresponding to it.

A position transducer 21, such as a transducer of the LVDT type, is associated with each blister 14 which locates between the plates 15 and 16 and is operative to detect their relative positions, substantially corresponding to the height of the blister 14 and to output a corresponding signal to that height.

It should be noted that each pair of blisters 13 and 14, with their respective resistance heaters 18 and 19, pressure transducers 20, and position transducers 21, along with the plates 15 and 16, form an assembly 22 which constitutes a unit adapted for individual handling and pre-fabrication, to be subsequently embedded within the polyurethane of the cushions 6 and 7.

To the unit 22 there extend power cables 23 and 24 for the resistance heaters 18 and 19 from a battery 25, via respective remote control switches 26 and 27 operable from a remote pushbutton panel 28, preferably of the so-called remote control type.

A control unit 29, powered from the battery 25 via a cable 35, is supplied, over cables 36 and 37, the pressure and height signals from the pressure transducer 20 and position transducer 21, respectively.

The control unit 29 is also supplied reference pressure and height values which are set by means of the pushbutton panel 28 and stored along with an acknowledgment code for a user on the easy chair.

The control unit 29 will process difference signals between the output signals from the transducers and the reference values to issue respective difference signals which are supplied over cables 30 and 31 to operate the remote control switches 26 and 27, respectively.

The battery 25, remote control switches 26 and 27, and control unit 29 are advantageously mounted in a recess 32 formed in the frame of the easy chair 1 below the seat 4.

The numeral 33 denotes an array of photovoltaic cells carried on the frame 2 rearwardly of the backrest 5, which photovoltaic cells are connected to the battery 25 via a cable 34 for recharge.

The pushbutton panel 28 comprises fifteen keying pushbuttons, one for each of said areas of the seat and backrest, which are numbered "1" to "15", and a pushbutton, indicated at A, for enabling two control pushbuttons of the remote control switch 27, indentified with "+" and "−", and either increase or decrease the temperature within the blister 14 and, accordingly, vary the blister height until a desired value is reached.

A similar pushbutton, indicated at R, is provided in the pushbutton panel 28 to enable two control pushbuttons for the remote control switch 26, identified with "+" and "−", and either increase or decrease the temperature in the blister 13, and hence, vary the pressure prevailing within the blister to a desired value.

A pushbutton M is provided to store said height and pressure values as reference values, and a pushbutton C is provided to allow entering of the user identification code in the memory using for this purpose the same keying pushbuttons as discussed hereinabove and designated "1" to "15".

The operation of an easy chair according to this invention will be next described with reference to a starting condition whereby the blisters 13 and 14 are in respective states characterized by a particular pressure level for blisters 13 and a particular height for blisters 14.

The user, after operating the keying pushbutton A and then selecting the various areas, from "1" to "15", would then depress the pushbuttons, "+" or "−", for each of the areas in order to respectively increase or decrease the temperature of the fluid in the blister, and thereby its volume and the height of the blister 14 in that area, until a desired height is obtained in that area.

For each area, the user may store the value of an optimum height so achieved, along with the user's own identification code.

In quite a similar manner, the user, after operating the keying pushbutton R and then selecting the various areas, would depress, for each area, the pushbuttons, "+" or "−", to increase or decrease the fluid temperature and, hence, the pressure within the blister 13 in that area, until he/she obtains in that area a desired amount of rigidity. For each area, the user may store the value of the optimum pressure achieved, again together with his/her identification code.

Thus, a condition of optimum personal comfort is reached wherein, for each area of the seat and backrest, a preferred height and rigidity can be afforded at any one time.

This comfortable condition can be reset by the user even after a number of different users have been sitting in one easy chair by simply entering his/her own identification code.

For another aspect of this invention, in each unit 22, the electric resistance heaters 18 and 19 are replaced with Peltier-effect thermoelectronic elements indicated at 118 and 119, respectively.

Such components are known per se and offered for sale by many manufacturers, among which Cambridge Thermionic Corp, Borg Warner, Materials Electronic Products Corp., and Marlow Industries.

They either generate or absorb heat alternately at their opposing faces according to the direction of an electric current flowing through them.

The Peltier elements 118 and 119 would be powered by the battery 25 through the cables 23 and 24 which include remote change-over control switches 126 and 127 adapted to be remote controlled from respective pushbuttons provided in the pushbutton panel 28 to reverse the current direction.

Accordingly, the reversal in direction of the current being supplied to the Peltier elements 118 and 119 will result in heat being absorbed by the blisters 13 and 14, respectively.

Operation by the user of said pushbuttons brings about, therefore, a quick reduction in the volume of the blisters 13 and 14, thereby reducing rigidity and height to their lowest values.

The main advantage of an easy chair according to the invention resides in the uncommonly high degree of comfort afforded by it to users irrespective of their build and personal preferences.

A further advantage of the easy chair according to this invention is that its construction can be simple by virtue of the target height and rigidity parameters being achieved by heating fluid-filled blisters and without involving power drives and/or bulky mechanical arrangements such as fluid-operated jacks or electric motors.

Still another advantage afforded by the inventive easy chair is that it can be rapidly controlled to an inoperative condition of minimum height and rigidity, preparatory to receiving the necessary instructions to enter a fresh operating condition of height and rigidity to fit another user.

Understandably, the easy chair disclosed hereinabove may be variously modified and altered by a skilled person in the art to meet contingent requirements, without departing from the true scope of the invention as set forth in the appended claims.

I claim:

1. A cushion for an easy chair, sofa and the like comprising:

a plurality of deformable sealed blisters disposed in said cushion, each of said sealed blisters containing a fluid having a set boiling point near ambient room temperature and heater means disposed in said cushion adjacent each of said blisters for changing the temperature of said fluid in each blister in a manner to cause a liquid to vapor transition of at least some of the fluid to select the desired softness of the cushion.

2. A cushion as set forth in claim 1, wherein said fluid is comprised of a mixture of at least two Freons.

3. A cushion as set forth in claim 2, wherein said blisters are disposed in two sets with the blisters in one set being normally in a collapsed state and the blisters in the other set being normally in an expanded state.

4. A cushion as set forth in claim 3, wherein said two sets of blisters are disposed in two superimposed layers of blisters including an upper layer of blisters and a lower layer of blisters.

5. A cushion as set forth in claim 4, wherein the fluid in said upper layer of blisters has a boiling temperature of about 30° C.

6. A cushion as set forth in claim 5, wherein the fluid in said upper layer of blisters is a mixture containing 70% Freon 11 and 30% Freon 113.

7. A cushion as set forth in claim 4, wherein the fluid in the lower layer of blisters has a boiling temperature of about 40° C.

8. A cushion as set forth in claim 7, wherein the fluid in the lower layer of blisters is a mixture containing 20% Freon 11 and 80% Freon 113.

9. A cushion as set forth in claim 4, wherein said heater means are disposed adjacent the blisters in said lower layer of blisters and further comprising a push button panel having push buttons for controlling said heater means.

10. A cushion as set forth in claim 9, further comprising position transducers associated with each blister in said lower layer of blisters for providing a height signal indicative of the height of each blister.

11. A cushion as set forth in claim 10, further comprising a control unit connected to said position transducers for receiving the height signal for each blister and keying push buttons for storing each reference height signal and an identification code of a user.

12. A cushion as set forth in claim 11, further comprising push buttons for controlling the heater means disposed adjacent each blister in said upper layer of blisters.

13. A cushion as set forth in claim 12, further comprising pressure transducers associated with each blister in said upper layer of blisters for providing a pressure signal indicative of the pressure in each blister in said upper layer of blisters.

14. A cushion as set forth in claim 13, wherein each of said pressure transducers is connected to said control unit, said keying push buttons being operable for storing reference pusher values for each blister in said upper layer of blisters and an identification code of a user.

15. A cushion as set forth in claim 14, wherein said heater means are comprised of electric resistant heaters.

16. A cushion as set forth in claim 14, wherein said heater means are comprised of Peltier elements.

* * * * *